US008240799B2

(12) United States Patent
Kasahara

(10) Patent No.: US 8,240,799 B2
(45) Date of Patent: Aug. 14, 2012

(54) INKJET PRINTING APPARATUS AND PRINTHEAD CONTROL METHOD OF THE APPARATUS

(75) Inventor: Takashi Kasahara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 437 days.

(21) Appl. No.: 12/633,935

(22) Filed: Dec. 9, 2009

(65) Prior Publication Data

US 2010/0156974 A1 Jun. 24, 2010

(30) Foreign Application Priority Data

Dec. 24, 2008 (JP) ..... 2008-328657

(51) Int. Cl.
*B41J 29/38* (2006.01)

(52) U.S. Cl. ..... 347/10; 347/17

(58) Field of Classification Search ..... 347/10
See application file for complete search history.

(56) References Cited

U.S. PATENT DOCUMENTS 6,113,211 A * 9/2000 Imai ..... 347/17

FOREIGN PATENT DOCUMENTS

| | | |
|---|---|---|
| JP | 7-266564 | 10/1995 |
| JP | 9-193395 | 7/1997 |
| JP | 3948939 | 4/2007 |

* cited by examiner

*Primary Examiner* — Uyen Chau N Le
*Assistant Examiner* — Kajli Prince
(74) *Attorney, Agent, or Firm* — Fitzpatrick, Cella, Harper & Scinto

(57) ABSTRACT

A control signal is generated to control ink discharge from a printhead. Urgency of A/D conversion of a detection signal is generated in accordance with a position represented by a signal output from an encoder. Upon determining based on the urgency to perform A/D conversion, control signal generation stops. Upon determining that a printing operation is not being performed, control is executed to A/D convert the detection signal. However, upon determining that the printing operation is being performed, control is executed to perform A/D conversion after the end of the printing operation. The stopped control signal generation is immediately resumed if it is determined that the A/D conversion has ended. Upon determining that the A/D conversion has not ended, however, control signal generation is resumed after the end of the A/D conversion.

5 Claims, 9 Drawing Sheets

INKJET PRINTING APPARATUS AND PRINTHEAD CONTROL METHOD OF THE APPARATUS

BACKGROUND OF THE INVENTION

1. Field of the Invention

The present invention relates to an inkjet printing apparatus for controlling driving of a printhead and a printhead control method of the apparatus.

2. Description of the Related Art

In recent years, inkjet printers are now widespread and common in home use due to a drop in price. They are becoming more complex to support, for example, a direct print function from a portable medium such as an IrDA or Compact Flash® as well as a copy function. The inkjet printers are currently used to print not only simple documents but also images such as photos. Under these circumstances, higher image quality is demanded.

One of the factors that greatly influence the image quality of an inkjet printer is the stability of ink amounts discharged from nozzles provided on the inkjet printhead. To improve photo image quality, smooth gradation printing is necessary. This is attained by distributing the number of discharged droplets of color inks of yellow, magenta, cyan, and the like to smoothly print gradation. Gradation is thus expressed by the number of discharged droplets. Hence, if the discharge amounts have errors, smooth gradation cannot be expressed.

One of inkjet printhead schemes heats a heater provided in each nozzle to generate bubbles and discharges ink from the nozzle by the force of the bubbles. In this scheme, the amount of heat to be applied to the heater is controlled, thereby controlling the bubble generation amount and consequently controlling the discharge amount. However, during continuous printing, heat storage around the nozzles, heat storage of inks in the ink tanks, a temperature rise in the printing apparatus, and the like influence the discharge amount. For this reason, the discharge amount varies even when a predetermined amount of heat is continuously applied to the heater. To avoid this, it is necessary to detect the temperature near the inkjet printhead and control the amount of heat to be applied to the heater in consideration of the temperature information.

As an arrangement for detecting the temperature near the inkjet printhead, a temperature sensor such as a diode sensor is sometimes provided in the printhead. However, the current to make the sensor function is much smaller than the current to drive the printhead and is therefore readily affected by noise. Additionally, print data transfer to the printhead is done at several tens of MHz in order to increase the speed of the printing apparatus. The influence of noise from such a driving signal is also large.

To avoid the influence of noise between the driving signals of the temperature sensor and the printhead, a measure is conventionally taken on a substrate pattern or using a bypass capacitor. However, this method poses the following problem.

The accuracy of temperature detection by a diode sensor during a printing operation is poor because of the influence of noise generated by printhead driving. Hence, control needs to be performed while ensuring a large margin. This increases the time and frequency of pauses to lower the printhead temperature.

On a substrate pattern, a measure is taken by surrounding the noise source by a ground. Alternatively, a flexible substrate without any high-rate signal arranged adjacent to a sensor signal is used, or a plurality of flexible substrates are stacked without arranging any high-rate signal at the same position of opposing flexible substrates. However, these methods impose restrictions on the pattern design.

The waveform of, for example, a clock signal used to transfer print data to the printhead often exhibits a fall time shorter than a rise time and largely affects the diode sensor signal in falling. For this reason, if a measure is taken using only a bypass capacitor, the noise smoothing result is localized to the positive or negative side. That is, the influence of noise cannot be completely eliminated.

An arrangement for avoiding the influence of noise of printhead driving detects a period where the printhead is not driven and detects the temperature during that period. According to the description of Japanese Patent Laid-Open No. 7-266564, the disable period of a pulse signal which controls heating for ink discharge is detected, and temperature data is sampled during the detected period. This described method is said to be able to detect temperature accurately because temperature data is sampled during the period without the noise generation source.

In this proposal, however, the disable period of the pulse signal for printhead control is simply detected. If the temporal density of driving signals rises along with an increase in the speed of the printing apparatus, or the number of driving signals increases for more complex driving, it may be impossible to obtain a disable period sufficient for temperature data sampling. Additionally, since the carriage position at the time of temperature detection is not detected, it is impossible to manage the appropriate carriage position to be reflected on print pulse control.

In another arrangement, not only the printhead driving signal but also another signal for motor driving, for example, is regarded as a noise source. According to the description of Japanese Patent Laid-Open No. 9-193395, a temperature information signal is received only when the carriage motor for moving the printhead or carriage or the conveyance motor for conveying a printing medium is not driven. This method is stated to be able to accurately measure the temperature without any influence of noise from not only the printhead but also other noise sources.

However, since the disable period of a portion serving as a noise source is detected simply, it may be impossible to obtain a disable period sufficient for temperature data sampling, as in the above-described arrangement. Japanese Patent Laid-Open No. 9-193395 describes a carriage motor and a conveyance motor for conveying a printing medium. In a recent printing apparatus, the carriage motor and conveyance motor sometimes operate simultaneously at the time of switching to speed up the operation. In such a case, there is no noise source disable period, and temperature control of the printing apparatus is impossible. In Japanese Patent Laid-Open No. 9-193395 as well, since the carriage position at the time of temperature detection is not detected, it is impossible to manage the appropriate carriage position to be reflected on print pulse control.

An arrangement also exists which obtains, in an inkjet printhead using piezoelectric elements, a temperature from the electrostatic capacitance of a piezoelectric element for discharge which is provided in each ink nozzle. Japanese Patent No. 3948939 states that since a piezoelectric element accumulates charge by driving pulses applied for ink discharge, a change in the charge accumulation amount caused by the temperature is detected, thereby detecting the temperature of each nozzle.

However, Japanese Patent No. 3948939 does not mention noise during temperature detection at all. In addition, since the carriage position at the time of temperature detection is not detected, the appropriate position to be reflected on print pulse control cannot be managed, as in the above-described techniques.

Conventionally, a driving signal disable period having a time width necessary for temperature data sampling cannot be obtained in some cases. That is, it is sometimes impossible to obtain temperature data at a necessary timing. In addition, since the position of the inkjet printhead during temperature detection is unknown, it may be impossible to switch the driving pulse at an appropriate timing.

SUMMARY OF THE INVENTION

An aspect of the present invention is to eliminate the above-mentioned problems with the conventional technology.

The present invention provides an inkjet printing apparatus capable of performing accurate temperature detection at an appropriate timing, and a printhead control method of the apparatus. The present invention in its first aspect provides an inkjet printing apparatus including an encoder which outputs a signal representing a position of a printhead that reciprocally moves in a predetermined direction, a sensor which detects a temperature of the printhead, and a converter which analog-digital converts a detection signal detected by the sensor, comprising:

a first generation unit configured to generate, based on the signal outputted from the encoder, a control signal to control ink discharge from the printhead;

a second generation unit configured to generate urgency of analog-digital conversion of the detection signal in accordance with the position represented by the signal outputted from the encoder;

a first determination unit configured to determine based on the urgency whether to cause the converter to perform analog-digital conversion;

a stop unit configured to stop control signal generation by the first generation unit if the first determination unit has determined to cause the converter to perform analog-digital conversion;

a second determination unit configured to determine whether a printing operation by the printhead is being performed;

an analog-digital conversion control unit configured to control to cause the converter to perform analog-digital conversion of the detection signal if the second determination unit has determined that the printing operation by the printhead is not being performed, if the second determination unit has determined that the printing operation by the printhead is being performed, control to cause the converter to perform analog-digital conversion of the detection signal after an end of the printing operation by the printhead;

a third determination unit configured to determine whether the analog-digital conversion has ended; and a resumption unit configured to immediately resume control signal generation stopped by the stop unit if the third determination unit has determined that the analog-digital conversion has ended, if the third determination unit has determined that the analog-digital conversion has not ended, resume control signal generation stopped by the stop unit after an end of the analog-digital conversion.

The present invention in its second aspect provides a printhead control method executed in an inkjet printing apparatus including an encoder which outputs a signal representing a position of a printhead that reciprocally moves in a predetermined direction, a sensor which detects a temperature of the printhead, and a converter which analog-digital converts a detection signal detected by the sensor, the method comprising the steps of:

generating, based on the signal output from the encoder, a control signal to control ink discharge from the printhead;

generating urgency of analog-digital conversion of the detection signal in accordance with the position represented by the signal output from the encoder;

determining based on the urgency whether to cause the converter to perform analog-digital conversion;

stopping control signal generation in the step of generating the control signal if it is determined, in the step of determining whether to cause the converter to perform analog-digital conversion, to cause the converter to perform analog-digital conversion;

determining whether a printing operation by the printhead is being performed;

controlling to cause the converter to perform analog-digital conversion of the detection signal if it is determined, in the step of determining whether the printing operation is being performed, that the printing operation by the printhead is not being performed, but if it is determined, in the step of determining whether the printing operation is being performed, that the printing operation by the printhead is being performed, controlling to cause the converter to perform analog-digital conversion of the detection signal after an end of the printing operation by the printhead;

determining whether the analog-digital conversion has ended; and immediately resuming control signal generation stopped in the step of stopping control signal generation if it is determined, in the step of determining whether the analog-digital conversion has ended, that the analog-digital conversion has ended, but if it is determined, in the step of determining whether the analog-digital conversion has ended, that the analog-digital conversion has not ended, resuming control signal generation stopped in the step of stopping control signal generation after an end of the analog-digital conversion.

According to the present invention, it is possible to perform accurate temperature detection at an appropriate timing.

Further features of the present invention will become apparent from the following description of exemplary embodiments with reference to the attached drawings.

DESCRIPTION OF THE EMBODIMENTS

Figure 1:
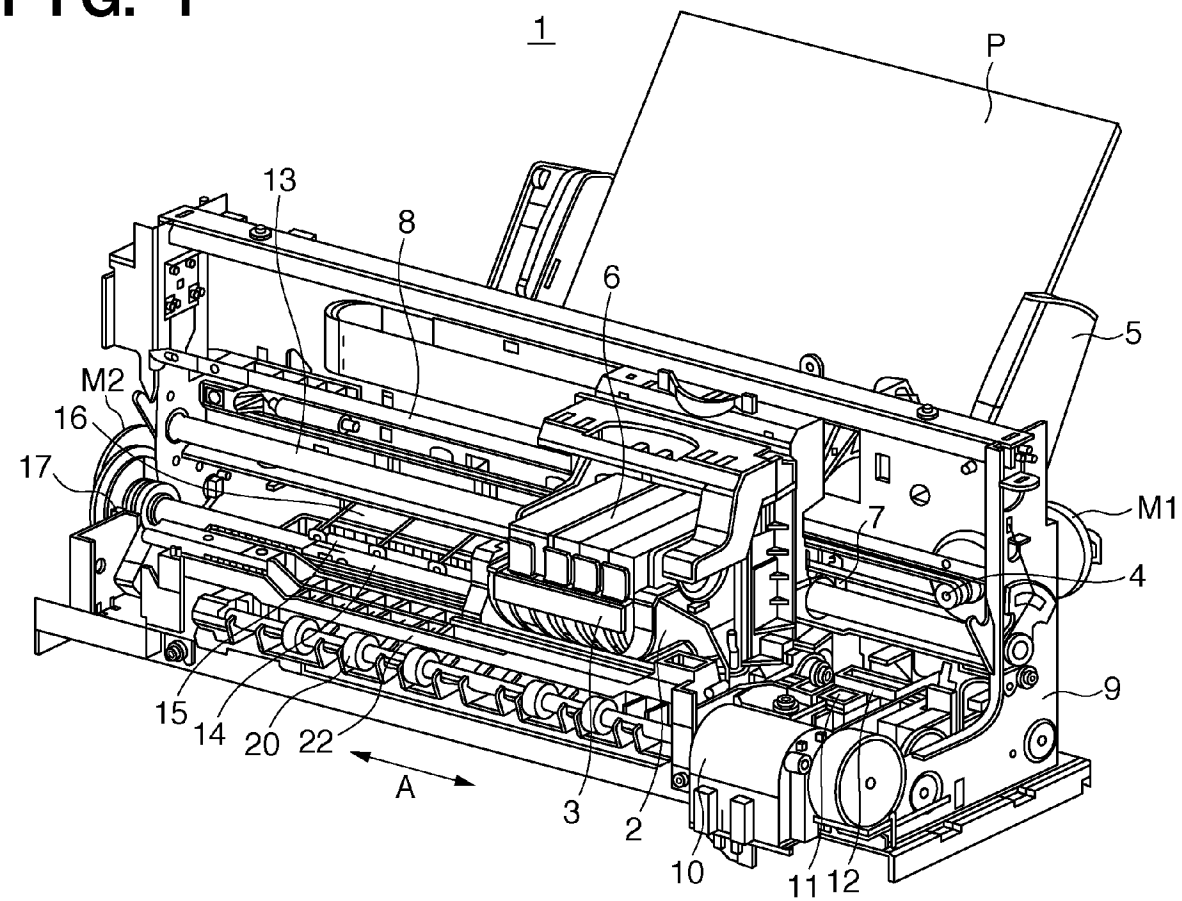
FIG. 1 is an external perspective view showing a schematic arrangement of an inkjet printing apparatus according to a typical embodiment of the present invention.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

Note that the same reference numerals denote the same constituent elements, and a description thereof will be omitted.

<Embodiment>

A preferred embodiment of the present invention will now be described in detail in accordance with the accompanying drawings. Note that in the embodiment to be described below, a printing apparatus using a printhead complying with an inkjet scheme will be exemplified.

In this specification, "printing" (to be also referred to as "print") is not limited to formation of significant information such as a character or figure. In addition, in a broad sense, "printing" is to form an image, design, pattern, or the like on a printing medium or process a medium regardless of whether information is significant or insignificant, or whether information is so visualized as to allow the user to visually perceive it.

"Printing media" are not only paper used in a general printing apparatus, but also ink-receivable materials such as cloth, plastic film, metal plate, glass, ceramics, wood, and leather in a broad sense.

"Ink" (to be also referred to as "liquid") should be interpreted as widely as the definition of "printing (print)". "Ink" represents a liquid which is applied onto a printing medium to form an image, design, pattern, or the like, process the printing medium, or contribute to ink processing (e.g., solidification or insolubilization of a coloring material in ink applied to a printing medium).

"Nozzles" comprehensively mean discharge orifices or liquid channels which communicate with them, and elements which generate energy used to discharge ink, unless otherwise specified.

<Explanation of Inkjet Printing Apparatus (FIG. 1)>

FIG. 1 is an external perspective view showing a schematic arrangement of an inkjet printing apparatus 1 according to a typical embodiment of the present invention.

As shown in FIG. 1, in the inkjet printing apparatus (to be referred to as a printing apparatus hereinafter), a carriage motor M1 generates a driving force, and a transfer mechanism 4 transfers it to a carriage 2 including a printhead 3 which prints by discharging ink in accordance with an inkjet scheme, thereby reciprocally moving the carriage 2 in the direction of an arrow A. In addition, a printing medium P such as a printing paper sheet is fed via a paper feed mechanism 5 and conveyed up to a print position. The printhead 3 discharges ink onto the printing medium P at the print position, thereby printing.

To keep the printhead 3 in a good condition, the carriage 2 is moved to the position of a recovery device 10 to execute discharge recovery processing of the printhead 3 intermittently.

Not only the printhead 3 but also ink cartridges 6 storing inks to be supplied to the printhead 3 are attached to the carriage 2 of the printing apparatus 1. The ink cartridges 6 are detachable from the carriage 2.

The printing apparatus 1 shown in FIG. 1 is capable of color printing. Hence, the carriage 2 includes four ink cartridges which store magenta (M), cyan (C), yellow (Y), and black (K) inks, respectively. The four ink cartridges can be detached independently.

The carriage 2 and the printhead 3 can attain and maintain a required electrical connection by appropriately bringing their connecting surfaces into contact. The printhead 3 applies energy in accordance with a print signal to selectively discharge the inks from a plurality of orifices for printing. Especially, the printhead 3 of this embodiment adopts an inkjet scheme for discharging inks using thermal energy and therefore has electrothermal transducers to generate thermal energy. Electric energy applied to the electrothermal transducers is converted into thermal energy. When the thermal energy is applied to inks, film boiling occurs. Using a change in pressure caused by bubble growth and contraction upon film boiling, the inks are discharged from the orifices. The electrothermal transducers are provided in correspondence with the orifices, respectively. A pulse voltage is applied to corresponding electrothermal transducers in accordance with a print signal, thereby discharging the inks from corresponding orifices.

As shown in FIG. 1, the carriage 2 is connected to a driving belt 7 of the transfer mechanism 4 for transferring the driving force of the carriage motor M1 so as to be slidably guided and supported in the direction of the arrow A along a guide shaft 13. Hence, the carriage 2 reciprocally moves along the guide shaft 13 as the carriage motor M1 rotates in the forward and reverse directions. There is a scale 8 to indicate the absolute position of the carriage 2 along its moving direction (the direction of the arrow A). In this embodiment, a transparent PET film with black bars printed on it at a necessary pitch is used as the scale 8. One end of the scale 8 is fixed on a chassis 9, and the other end is supported by a leaf spring (not shown).

The printing apparatus 1 also includes a platen (not shown) facing the orifice surface of the printhead 3 where the orifices (not shown) are formed. When the carriage 2 with the printhead 3 reciprocally moves by the driving force of the carriage motor M1, and simultaneously, a print signal is supplied to the printhead 3 to discharge inks, printing is performed in full width on the printing medium P conveyed onto the platen.

Referring to FIG. 1, a conveyance motor M2 drives a conveyance roller 14 to convey the printing medium P. A pinch roller 15 brings the printing medium P in contact with the conveyance roller 14 via a spring (not shown). A pinch roller holder 16 rotatably supports the pinch roller 15. A conveyance roller gear 17 is fixed at one end of the conveyance roller 14. Rotation of the conveyance motor M2 which is transferred to the conveyance roller gear 17 via an intermediate gear (not shown) drives the conveyance roller 14.

A discharge roller 20 discharges the printing medium P with an image formed by the printhead 3 outside the printing apparatus. Rotation of the conveyance motor M2 is transferred to drive the discharge roller 20. Note that the discharge roller 20 brings the printing medium P in contact with a spur roller (not shown) via a spring (not shown). A spur holder 22 rotatably supports the spur roller.

As shown in FIG. 1, the printing apparatus 1 also includes the recovery device 10 for recovering discharge failures of the printhead 3 at a desired position (for example, a position corresponding to the home position) outside the reciprocal motion for the printing operation of the carriage 2 having the printhead 3 (outside the printing region).

The recovery device 10 includes a capping mechanism 11 which caps the orifice surface of the printhead 3, and a wiping mechanism 12 which cleans the orifice surface of the printhead 3. In synchronism with orifice surface capping by the capping mechanism 11, a suction unit (e.g., suction pump) in the recovery device 10 forcibly discharges inks from the orifices. In this way, discharge recovery processing is executed to, for example, remove viscous inks, bubbles, and the like from the ink channels of the printhead 3.

In, for example, a non-printing operation, the capping mechanism 11 caps the orifice surface of the printhead 3 to protect the printhead 3 and also prevent inks from evaporating and drying. The wiping mechanism 12 is arranged near the capping mechanism 11 to wipe ink droplets sticking to the orifice surface of the printhead 3.

The capping mechanism 11 and the wiping mechanism 12 are able to maintain the normal ink discharge state of the printhead 3.

<Control Configuration of Inkjet Printing Apparatus (FIG. 2)>

Figure 2:
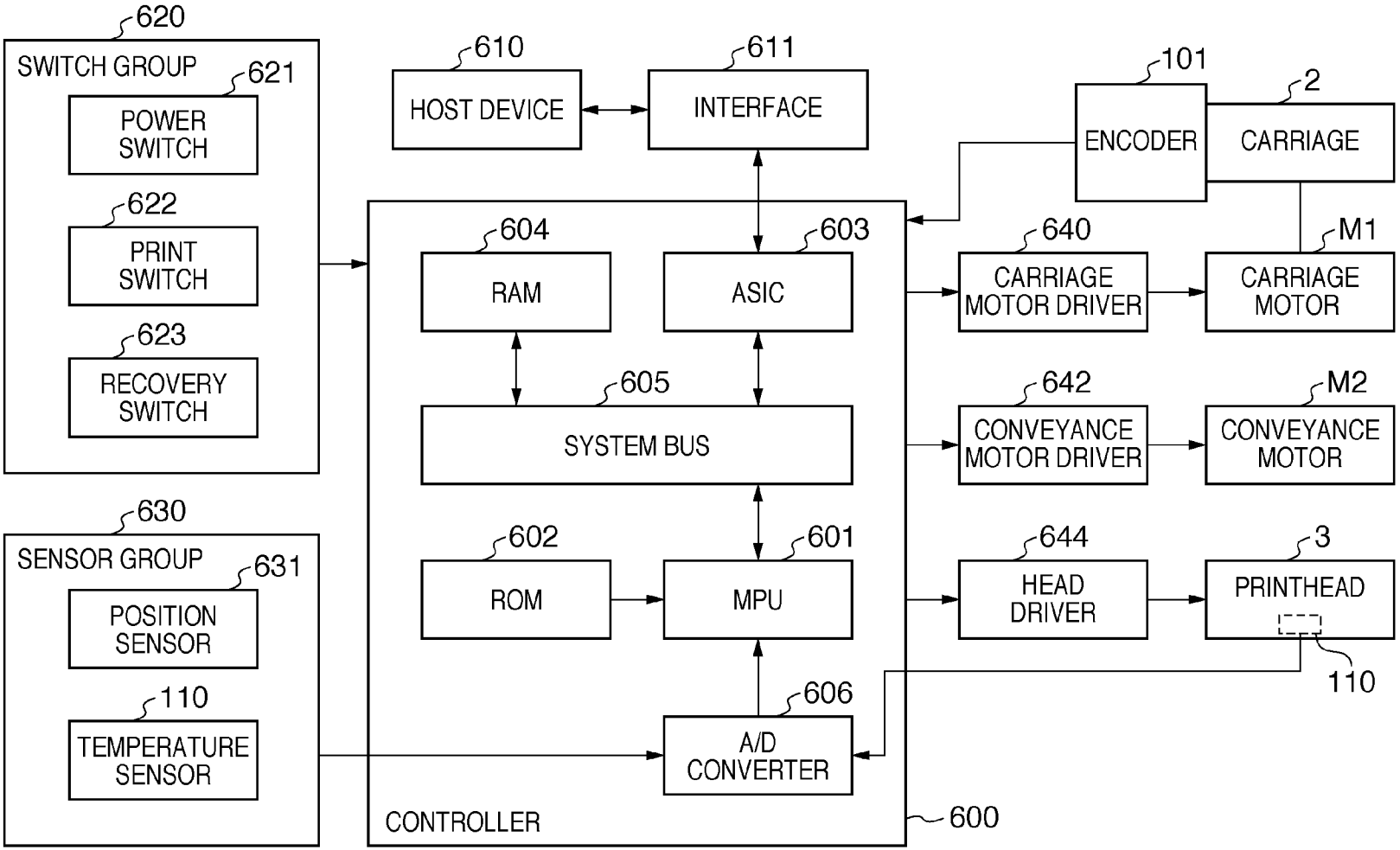
FIG. 2 is a block diagram showing the arrangement of the control circuit of the printing apparatus.

FIG. 2 is a block diagram showing the control configuration of the printing apparatus shown in FIG. 1.

As shown in FIG. 2, a controller 600 includes an MPU 601, a ROM 602 which stores programs corresponding to control sequences to be described later, necessary tables, and other permanent data, an application specific integrated circuit (ASIC) 603 which generates control signals to control the carriage motor M1, conveyance motor M2, and printhead 3, a RAM 604 including an image data rasterization area and a work area for program execution, a system bus 605 which connects the MPU 601, ASIC 603, and RAM 604 to each other to exchange data, and an A/D (analog-digital) converter 606 which receives an analog signal from a sensor group to be explained below, A/D-converts it, and supplies a digital signal to the MPU 601.

Referring to FIG. 2, a computer 610 is a computer (or, e.g., a reader for image reading or a digital camera) serving as an image data supply source which is generally called a host device. The host device 610 transmits/receives image data, commands, and status signals to/from the printing apparatus 1 via an interface (I/F) 611.

A switch group 620 includes switches to receive instructions from the operator such as a power switch 621, a print switch 622 to instruct print start, and a recovery switch 623 to instruct activation of processing (recovery processing) for maintaining the ink discharge performance of the printhead 3 in a good condition. A sensor group 630 includes sensors to detect an apparatus state such as a position sensor 631 formed from, for example, a photocoupler to detect a home position h, and a temperature sensor 110 provided at an appropriate position of the printing apparatus to detect the ambient temperature.

A carriage motor driver 640 drives the carriage motor M1 to reciprocally scan the carriage 2 in the direction of the arrow A. A conveyance motor driver 642 drives the conveyance motor M2 to convey the printing medium P. A head driver 644 drives the printhead 3. The printhead 3 includes the above-described temperature sensor 110 for detecting the temperature of the printhead. The temperature sensor 110 outputs a detection signal to the A/D converter 606.

At the time of print scanning of the printhead 3, the ASIC 603 transfers printing element (discharge heater) driving data (DATA) to the printhead while directly accessing the storage area of the ROM 602.

An encoder 101 detects the position of the carriage 2 which is reciprocally moved in predetermined directions by the carriage motor M1. A signal representing the position detected by the encoder 101 is input to the controller 600.

Note that the arrangement shown in FIG. 1 allows separating the ink cartridges 6 from the printhead 3. Instead, an interchangeable head cartridge may be formed by integrating the printhead and ink cartridges. In the embodiment to be described below, droplets discharged from the printhead are ink droplets, and the liquid stored in the ink tank is ink. However, the content is not limited to ink. For example, a kind of process solution which is discharged to a printing medium to increase the fixing effect and water repellency of a printed image or increase the image quality may be stored in the ink tank.

In the following embodiment, particularly, one of inkjet printing schemes is used which includes a unit (e.g., an electrothermal transducer or laser beam) for generating heat energy as energy to be utilized to discharge inks, and changes the ink state by the heat energy, thereby increasing the printing density and resolution.

A full line type printhead having a length corresponding to the maximum width of a printing medium printable by the printing apparatus can employ either a structure which meets the length by combining a plurality of printheads or a single integrated printhead structure as disclosed in the above-described specifications.

Additionally, in this embodiment, not only a cartridge type printhead which integrates an ink tank with a printhead itself but also an interchangeable chip type printhead which is attached to the apparatus main body so as to be electrically connected to it and receive inks from it is usable.

Furthermore, the printing apparatus according to the present invention can take the form of an integrated or separate image output terminal for an information processing device such as a computer. The printing apparatus may also take the form of a copying apparatus combined with a reader or the like, or the form of a facsimile apparatus having a transmission/reception function.

In the following embodiment, an encoder to obtain the position information of a carriage having an inkjet printhead and an arrangement for calculating a trigger interval to generate a printhead driving signal by estimating the carriage speed from the number of pulses of the encoder per unit time will be described. In addition, an arrangement for generating a heat trigger (to be explained later) from the given trigger interval and an arrangement for generating, from the heat trigger, an A/D trigger to detect the temperature of the inkjet printhead will be described.

Figure 3:
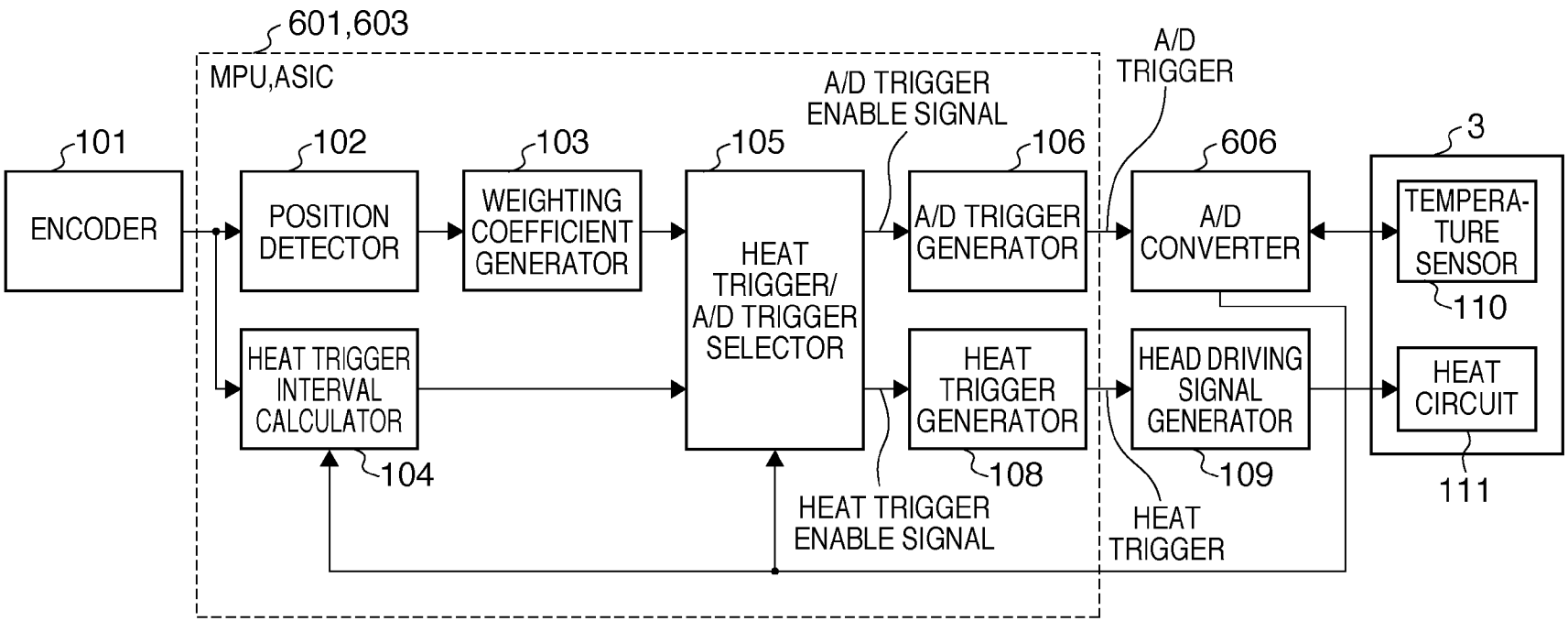
FIG. 3 is a block diagram showing the arrangement of printhead control based on a temperature detection signal and an encoder signal.

FIG. 3 is a block diagram showing the arrangement of printhead control based on a temperature detection signal and an encoder signal. A position detector 102, weighting coefficient generator 103, heat trigger interval calculator 104, heat trigger/A/D (analog-digital) trigger selector 105, A/D (analog-digital) trigger generator 106, and heat trigger generator 108 are implemented by the MPU 601 and the ASIC 603. The encoder 101 generates a pulse signal as the carriage with the inkjet printhead moves. The position detector 102 detects the carriage position based on the number of generated pulse signals. The weighting coefficient generator 103 generates a weighting coefficient in accordance with the carriage position. Based on the interval of pulse signals output from the encoder 101, the heat trigger interval calculator 104 calculates the interval of heat triggers which give a driving start timing to a printhead driving signal generator 109.

Based on the carriage position obtained by the position detector 102, the weighting coefficient obtained by the weighting coefficient generator 103 in correspondence with the carriage position, and the heat trigger interval, the heat trigger/A/D trigger selector 105 determines whether to generate an A/D trigger or a heat trigger. An A/D trigger is a signal that gives a sampling start timing to the A/D converter 606 for temperature detection. A heat trigger is a signal that gives a timing of causing a heat circuit 111 to output a head driving signal.

The A/D trigger generator 106 generates an A/D trigger to the A/D converter 606 when selected by the heat trigger/A/D trigger selector 105. For example, in this embodiment, the A/D trigger generator 106 is selected by an A/D trigger enable signal. The heat trigger generator 108 generates a heat trigger to the printhead driving signal generator 109 when selected by the heat trigger/A/D trigger selector 105. For example, in this embodiment, the heat trigger generator 108 is selected by a heat trigger enable signal. The inkjet printhead 3 includes the heat circuit 111 which drives the inkjet printhead, and the temperature sensor 110 which detects the temperature of the inkjet printhead.

Figure 4:
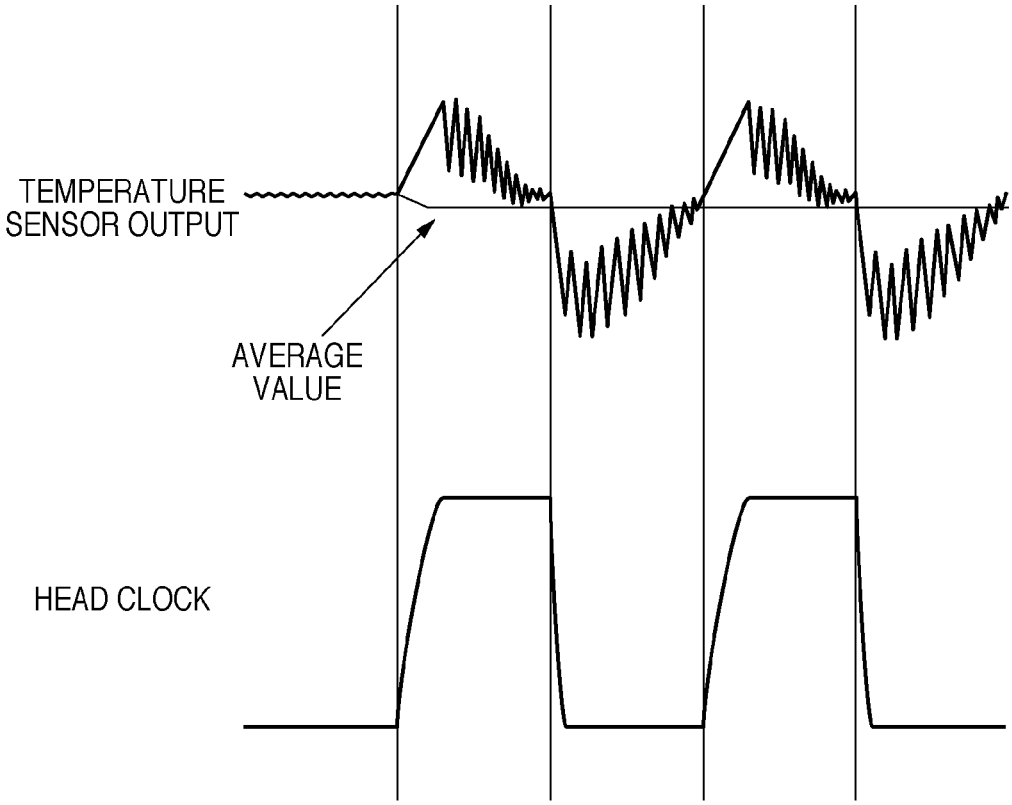
FIG. 4 is a timing chart showing an outline of noise a printhead driving signal gives to the output of a temperature sensor.

FIG. 4 is a timing chart showing an outline of noise a printhead driving signal gives to the output of the temperature sensor. FIG. 4 illustrates an example in which a printhead clock signal for data transfer to the printhead applies noise to the output of the temperature sensor. The waveform of the driving signal (printhead clock signal) often exhibits a fall time that is shorter than a rise time. The influence of crosstalk on neighboring signals is larger in falling than in rising. As a result, the output from a signal line affected by noise is localized to the higher or lower level on average. This means that providing a bypass capacitor for noise removal at the output of the temperature sensor does not guarantee accurate temperature detection because the output is localized to the higher or lower level as compared to a state without noise.

Figure 5:
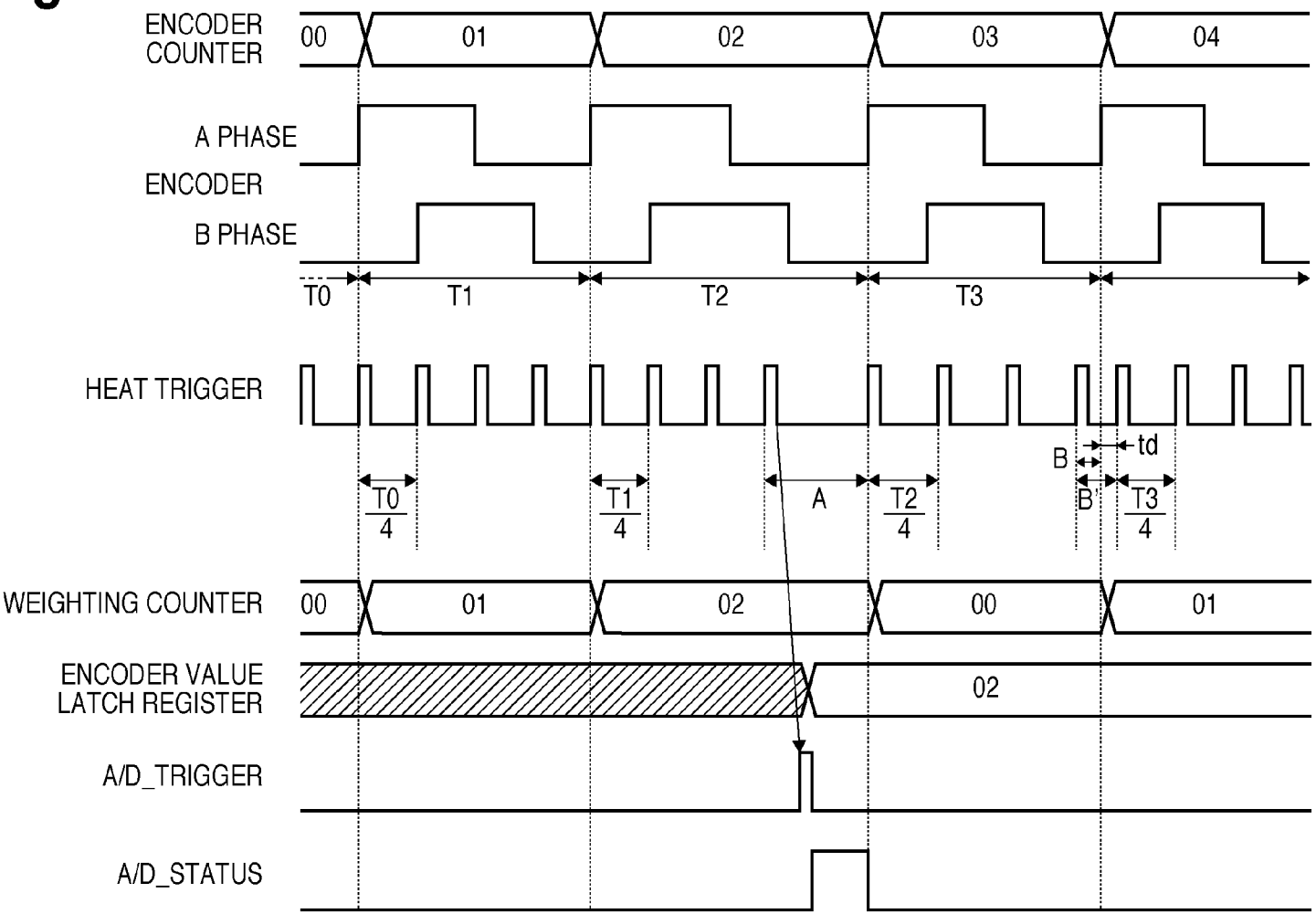
FIG. 5 is a timing chart for explaining an operation of starting analog-digital sampling according to the embodiment.

FIG. 5 is a timing chart for explaining an operation of starting A/D (analog-digital) sampling according to the embodiment. The relationship between the encoder waveform and the heat trigger interval in FIG. 5 will be explained first. In the printing apparatus of this embodiment, the time internal of a given encoder period is equally divided by the number of pulses of heat triggers generated in one period of the encoder. The interval obtained by equal dividing is applied as the interval of heat triggers to be generated in a period next to the encoder period. For example, FIG. 5 shows that the time interval of each of periods T0 to T3 is divided by 4, that is, the number of pulses of heat triggers generated in one encoder period, and the resultant value in each period is applied in the next period.

The moving speed of the carriage is not constant because it varies due to mechanical vibration and the like. As shown in FIG. 5, the interval of T0 equals that of T1. However, the time interval of T2 is longer than that of T1. In T3, the time interval shortens again. Under these circumstances, the heat trigger intervals are not uniform at the switching portion of the encoder period. In FIG. 5, an interval A between the heat trigger of the fourth pulse in the period T2 and that of the first pulse in the period T3 is longer than T1/4. The interval between the heat trigger of the fourth pulse in the period T3 and that of the first pulse in the next period is shorter than T2/4.

In such a case, to relax the steep change in the heat trigger interval, a heat trigger group is generated with delay in a period subsequent to a portion where the heat trigger interval shortens. For example, in FIG. 5, heat trigger generation is delayed from the period start by td. The delay td from the period start lengthens an interval B to an interval B' and relaxes the above-described interval shortening. The above-described heat trigger generation to relax the internal shortening is an example of a first generation unit according to the embodiment.

FIG. 5 illustrates an encoder counter value, A/D trigger, weighting counter, register value, and A/D status. The A/D trigger is a signal that gives an A/D sampling start timing to the A/D converter to sample the output of the temperature sensor. The weighting counter weights the encoder counter value to be used to determine whether to generate the A/D trigger. The register value is an encoder counter value latched when an A/D trigger is applied to the A/D converter. The A/D status is a signal representing that A/D sampling to the A/D converter is progressing.

In FIG. 5, the interval from the last heat trigger in the period T2 to the first heat trigger in the period T3 is long. This can be predicted by actually measuring the time of the period T2 based on the rise and fall timings of the A and B phases of the encoder at the start of the period T2. The actually measured time is compared with a time necessary for sampling data output from the temperature sensor, thereby determining whether to apply an A/D trigger to the A/D converter. If it is consequently determined to cause the A/D converter to start A/D conversion, an A/D trigger is generated.

In this embodiment, when determining A/D trigger generation, the carriage position in the printing apparatus is also taken into consideration. In inkjet printing, the discharge amount is dependent on the temperature of the printhead. It is therefore necessary to control the energy amount for discharge in accordance with the temperature of the printhead even during the printing operation. This is done using a method of dividing one raster (one scanning section) into a plurality of blocks and controlling the applied energy amount for each block.

In this case, the temperature of the printhead needs to be detected up to the end of each divided block. In addition, temperature measurement may be done near the end of each block. In this embodiment, the weighting counter for weighting a counted value is used in addition to the encoder counter. A/D trigger generation is determined based on the weighting counter value and the above-described heat trigger interval. In this embodiment, when an A/D trigger is generated, the encoder counter value at the time of generation is latched. This makes it possible to accurately acquire the temperature information of the printhead and the position where the information has been obtained.

Figure 6:
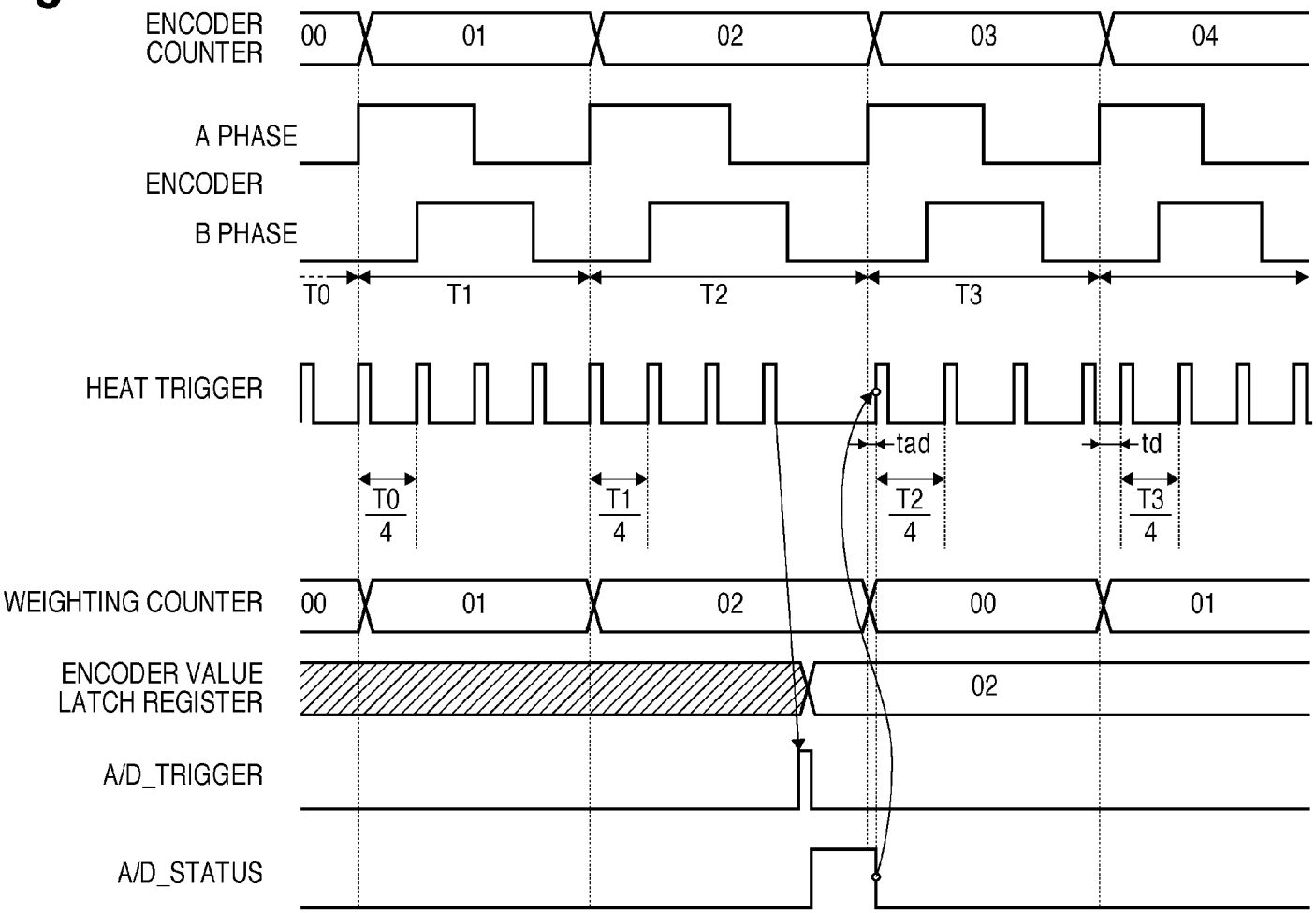
FIG. 6 is a timing chart for explaining the operation in FIG. 5 when A/D sampling to an A/D converter cannot finish within a predetermined time.

FIG. 6 is a timing chart for explaining control when A/D sampling to the A/D converter cannot finish within a predetermined time in the embodiment described with reference to FIG. 5.

Referring to FIG. 5, the start of A/D sampling to the A/D converter is predicted based on the heat trigger interval in the encoder period and the rise and fall timings of the A and B phases of the encoder signal. However, since this prediction is not guaranteed, the heat trigger timing of the next encoder period may come during sampling to the A/D converter. In this embodiment, when the A/D converter has started A/D sampling, heat trigger generation is prohibited until the end of the A/D sampling, thereby preventing generation of a heat trigger of the next encoder period during the A/D sampling.

For this purpose, in this embodiment, the A/D sampling operation of the A/D converter is detected by monitoring the A/D status signal, as shown in FIG. 6. Assume that the first heat trigger in the period T3 is to be generated during A/D sampling of the A/D converter. In this case, processing waits until the A/D status indicates completion of A/D sampling (for example, a change from high level to low level). When the A/D status indicates completion of A/D sampling, heat triggers are generated again. FIG. 6 shows that heat trigger generation in the period T3 delays by tad as a result. In this embodiment, A/D sampling is thus stopped or resumed in accordance with the change of the A/D status signal.

Figure 7:
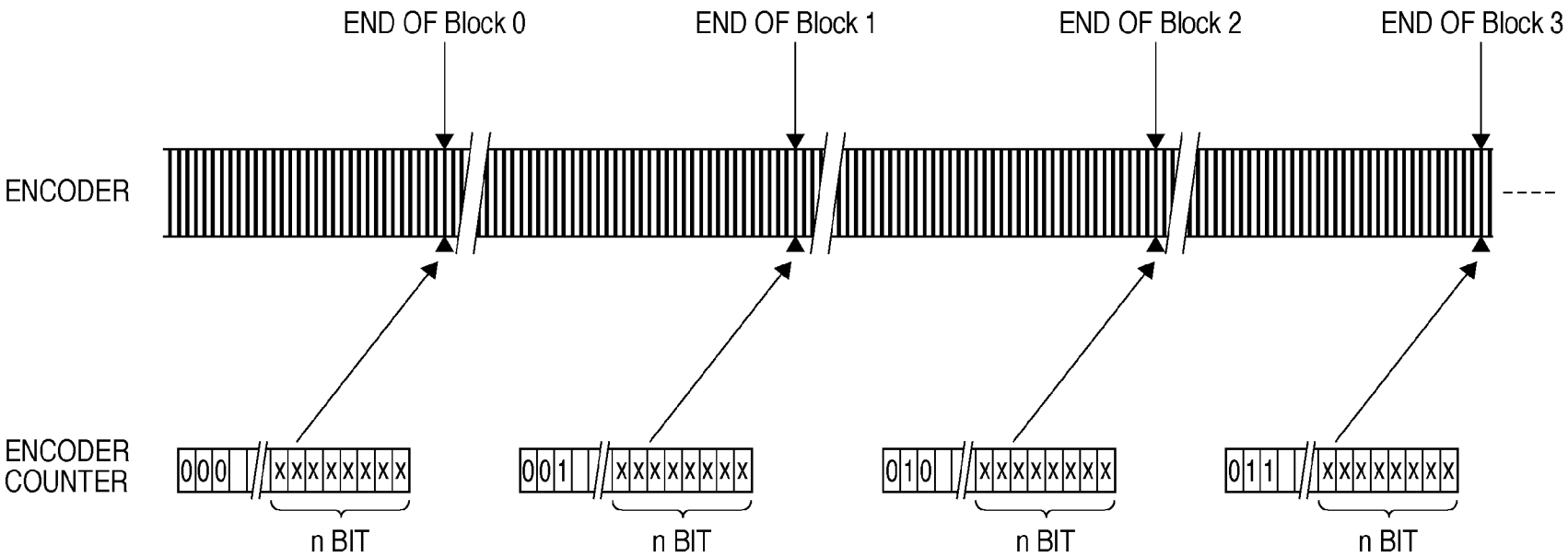
FIG. 7 is a view for explaining an encoder counter.

The arrangement of weighting explained with reference to FIG. 5 will be described next using FIGS. 7 and 8.

The encoder counter will be explained first with reference to FIG. 7. The upper portion of FIG. 7 illustrates an encoder film, and the lower portion of FIG. 7 illustrates the states of bits of the encoder counter at corresponding positions on the encoder film. In this embodiment, no special counter for each block described above is provided. Instead, a necessary number of upper bits of the encoder counter are assigned to identify each block. For example, in FIG. 7, three upper bits are assigned to divide one raster into eight blocks. The fourth bit to the least significant bit of the encoder counter can be regarded as a counter value representing a position in each block. Control to be described with reference to FIG. 8 is done in accordance with the position represented by the counter value.

Figure 8:
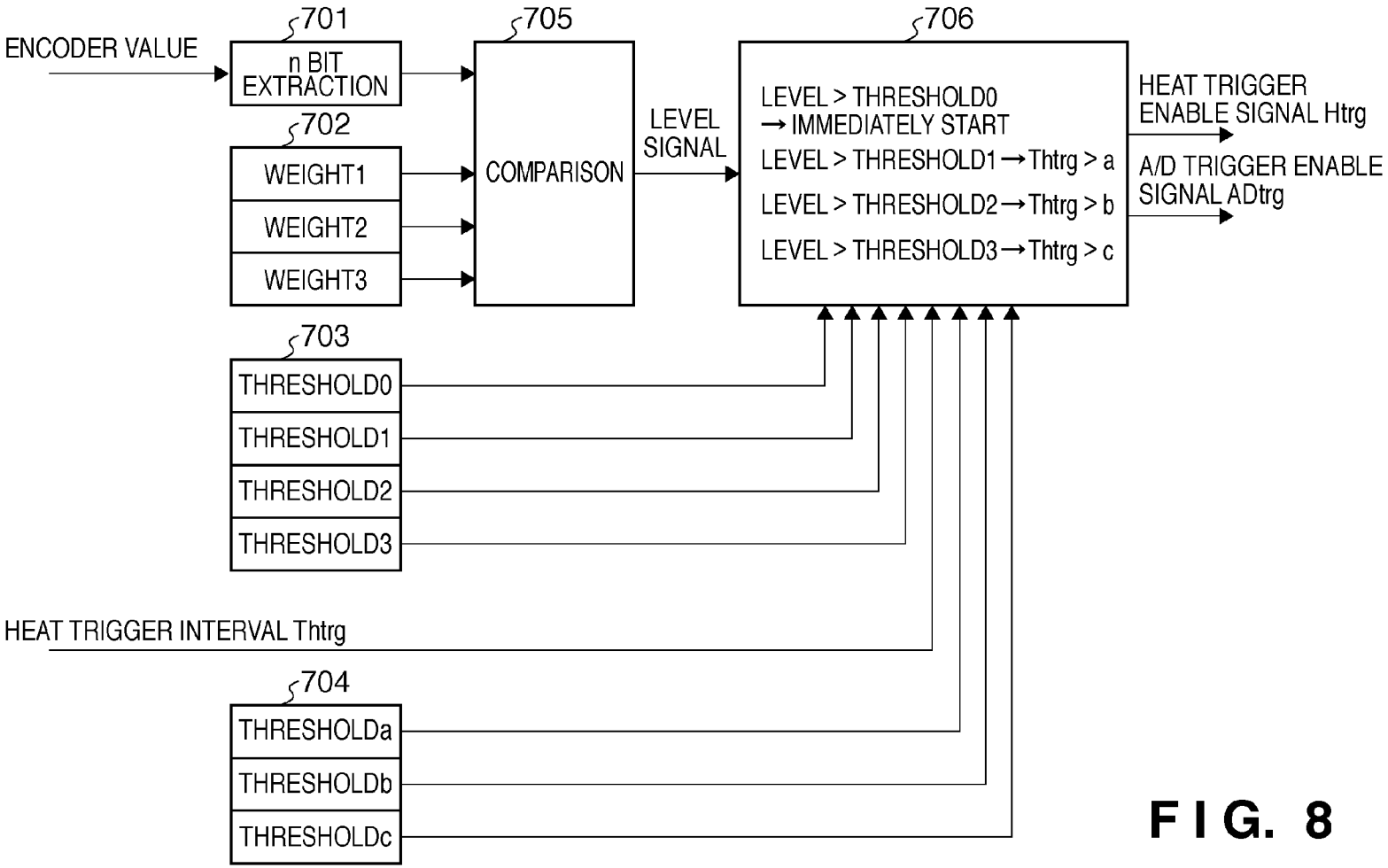
FIG. 8 is a block diagram showing an arrangement for selectively outputting a heat trigger Htrg and an A/D trigger ADtrg.

FIG. 8 is a block diagram showing an arrangement for selectively outputting a heat trigger enable signal Htrg to start control for printing and an A/D trigger enable signal ADtrg to start A/D conversion for temperature detection. The arrangement shown in FIG. 8 is implemented by the MPU 601 and the ASIC 603 shown in FIG. 3.

The heat trigger enable signal or A/D trigger enable signal is selected based on the encoder counter described with reference to FIG. 7, a weighting coefficient corresponding to a position in each block, a threshold, and information of a heat trigger interval Thtrg calculated from the cartridge speed. An encoder counter value represents a cartridge position on the raster. Masking the above-described three upper bits allows detecting where the cartridge exists in each block on the raster. In this example, n lower bits acquired by masking the three upper bits are extracted (block 701).

The counter value represented by the n lower bits is compared with weights 1 to 3 (stored in a register 702) so as to output a level signal corresponding to the position in each block (block 705). In this embodiment, the weight value is so set as to output a higher level as the cartridge position becomes closer to the end of a block. The above-described output of a level signal corresponding to the position in each block is an example of a second generation unit according to the embodiment.

In a block 706, the level signal value is compared with thresholds 0 to 3 preset in a register 703 to determine the urgency (degree of urgency) of temperature sampling. If the level is higher than highest threshold 0, the A/D trigger enable signal is immediately activated unconditionally to start temperature sampling. Otherwise, the heat trigger enable signal or the A/D trigger enable signal is selectively activated in accordance with the heat trigger interval Thtrg. When the heat trigger enable signal is activated, the heat trigger generator shown in FIG. 3 outputs a heat trigger. When the A/D trigger enable signal is activated, the A/D trigger generator shown in FIG. 3 outputs an A/D trigger.

The heat trigger enable signal is activated to preferentially issue a heat trigger if the level signal output from the block 705 is lower, and the heat trigger interval is narrower. If the level signal is higher, the A/D trigger enable signal is activated to give priority to A/D sampling even when the heat trigger interval is narrow. When A/D sampling has started, generation of the next heat trigger is delayed until the end of the A/D sampling, as described above.

In this embodiment, the heat trigger interval Thtrg is compared with thresholds a to c preset in a register 704. The thresholds a to c are selected after comparing the level signal value with thresholds 1 to 3. This implements performing temperature detection at a position near the end of each block in the scan direction. Since thresholds a to c can be changed by firmware, control suitable to each print mode can be performed.

Figure 9:
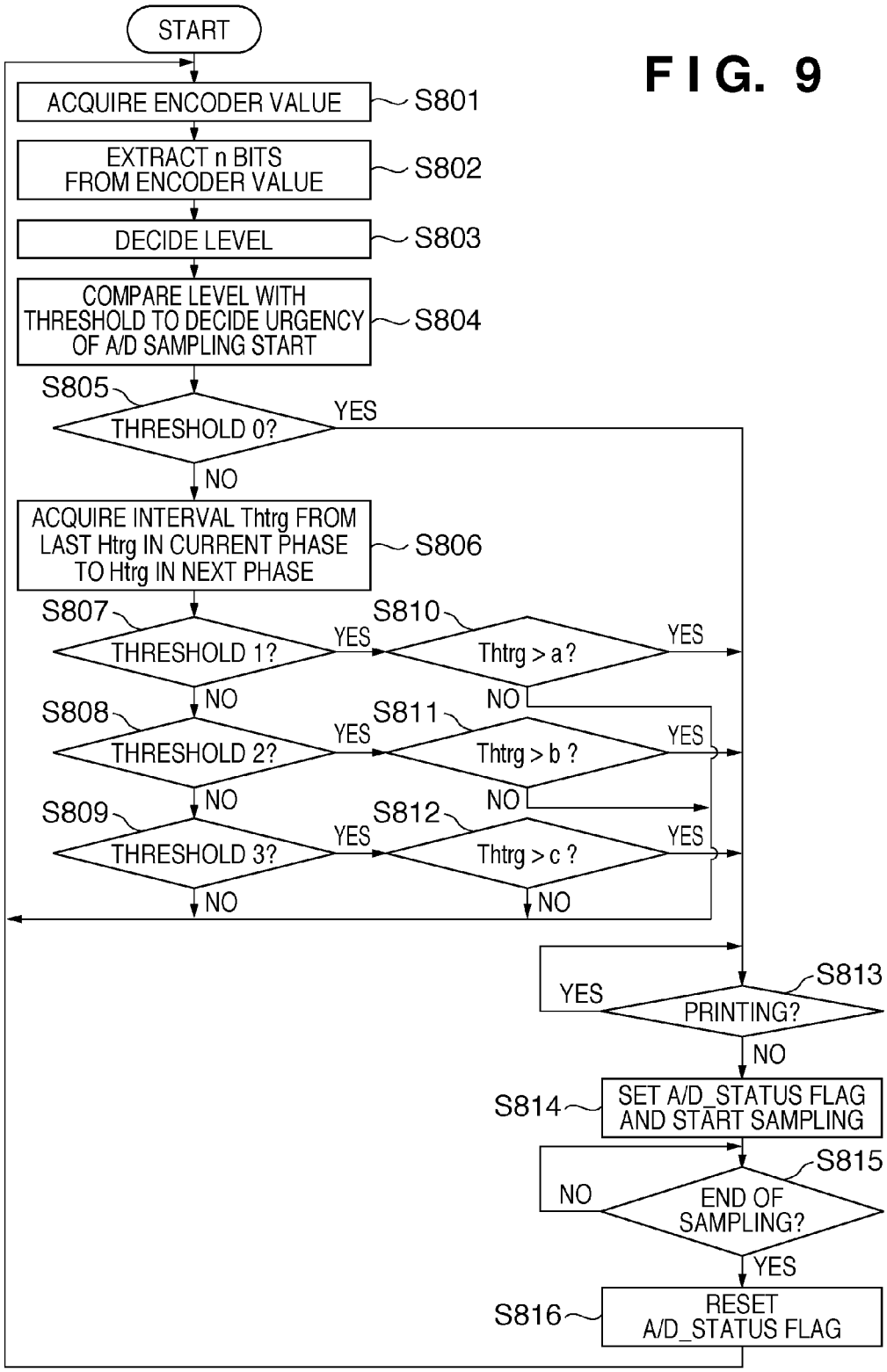
FIG. 9 is a flowchart illustrating a procedure of processing up to the start of A/D sampling according to the embodiment.

FIG. 9 is a flowchart illustrating a procedure of processing up to the start of A/D sampling according to the embodiment. In step S801, the encoder counter value is acquired. In step S802, n bits necessary for counting the position in each of a plurality of blocks obtained by dividing one raster are extracted from the encoder counter value. In step S803, the value of the extracted n bits is compared with weights 1 to 3 written in the register 702 to decide the level. The level signal generated upon comparison with weights 1 to 3 represents the urgency (degree of urgency) of A/D sampling.

In step S804, the decided level is compared with thresholds 0 to 3 stored in the register 703 to decide the urgency of starting A/D sampling. Thresholds 0 to 3 are set to be larger as the cartridge position represented by the n bits extracted from the encoder counter value in each block becomes closer to the end of the block. In this embodiment, threshold 0 represents the endmost position of a block within a range where A/D sampling can finish (that is, threshold 0 is the largest in thresholds 0 to 3).

In step S805, if the value of the extracted n bits is larger than threshold 0, it is determined that A/D sampling needs to start immediately, and the process advances to step S813. In step S813, it is determined whether the printing operation of the printhead is being performed. The process in step S813 is an example of a second determination unit according to the embodiment. Upon determining that the printing operation is not being performed, the A/D status flag is set to, for example, "1" in step S814 to start A/D sampling. If it is determined that the printing operation is being performed, the process waits for the end of the printing operation, and the process then advances to step S814 to start A/D sampling. The process in step S814 is an example of an A/D conversion control unit according to the embodiment.

In step S815, it is determined whether the A/D sampling has ended. Upon determining that the A/D sampling has not ended, step S815 is repeated until the end of A/D sampling. If it is determined that the A/D sampling has ended, the process advances to step S816 to reset the A/D status flag to, for example, "0", and the process returns to step S801 again. The process in step S815 is an example of a third determination unit according to the embodiment.

Step S805 will be explained again. In step S805, if the value is equal to or smaller than threshold 0, the process advances to step S806. When the process advances to step S806, it is determined that there is an extra time up to the A/D sampling start timing in the block where the carriage is located. In step S806, the heat trigger interval Thtrg from the last heat trigger in the current phase of the encoder period to the first heat trigger in the next phase is acquired.

In step S807, it is determined whether the value of the extracted n bits is larger than threshold 1. Upon determining that the value is larger than threshold 1, the process advances to step S810. In step S810, whether to start A/D sampling is determined based on whether the heat trigger interval Thtrg guarantees a sufficient time for A/D sampling. In this embodiment, the start of A/D sampling is determined by comparing the heat trigger interval Thtrg with threshold a stored in the register 704 in advance.

In step S810, if the heat trigger interval Thtrg is larger than threshold a, it is determined that A/D sampling needs to start, and the process advances to step S813. On the other hand, if the heat trigger interval Thtrg is equal to or smaller than threshold a, the process returns to step S801. If the value of the extracted n bits is equal to or smaller than threshold 1 in step S807, the process advances to step S808.

In step S808, it is determined whether the value of the extracted n bits is larger than threshold 2. Upon determining that the value is larger than threshold 2, the process advances to step S811. In step S811, whether to start A/D sampling is determined based on whether the heat trigger interval Thtrg guarantees a sufficient time for A/D sampling. In this embodiment, the start of A/D sampling is determined by comparing the heat trigger interval Thtrg with threshold b stored in the register 704 in advance.

In step S811, if the heat trigger interval Thtrg is larger than threshold b, it is determined that A/D sampling needs to start, and the process advances to step S813. On the other hand, if the heat trigger interval Thtrg is equal to or smaller than threshold b, the process returns to step S801. If the value of the extracted n bits is equal to or smaller than threshold 2 in step S808, the process advances to step S809.

In step S809, it is determined whether the value of the extracted n bits is larger than threshold 3. Upon determining that the value is larger than threshold 3, the process advances to step S812. In step S812, whether to start A/D sampling is determined based on whether the heat trigger interval Thtrg guarantees a sufficient time for A/D sampling. In this embodiment, the start of A/D sampling is determined by comparing the heat trigger interval Thtrg with threshold c stored in the register 704 in advance.

In step S812, if the heat trigger interval Thtrg is larger than threshold c, it is determined that A/D sampling needs to start, and the process advances to step S813. On the other hand, if the heat trigger interval Thtrg is equal to or smaller than threshold c, the process returns to step S801. If the value of the extracted n bits is equal to or smaller than threshold 3 in step S809, the process returns to step S801.

In this embodiment, the thresholds a to c serving as reference values have a relationship "a<b<c", and one of them is selected based on the result of comparison with thresholds 0 to 3. That is, if the urgency of A/D sampling is high, A/D sampling starts even when the heat trigger interval Thtrg is narrow.

The processes in steps S805, S807, S808, and S809 indicate an example of a first determination unit according to the embodiment. The processes in steps S810 to S812 indicate an example of a fourth determination unit according to the embodiment.

In this embodiment, four values are prepared in the register 703 as thresholds 0 to 3 to decide the level signal representing the urgency of A/D sampling. The number of thresholds need not always be four. The thresholds may be rewritten by firmware as needed in accordance with the print mode or the like. The heat trigger interval Thtrg is compared with thresholds a to c. The number of thresholds need not always be three.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-328657, filed Dec. 24, 2008, which is hereby incorporated by reference herein in its entirety.

What is claimed is:

1. An inkjet printing apparatus including an encoder which outputs a signal representing a position of a printhead that reciprocally moves in a predetermined direction, a sensor which detects a temperature of the printhead, and a converter which analog-digital converts a detection signal detected by the sensor, comprising:

a first generation unit configured to generate, based on the signal outputted from the encoder, a control signal to control ink discharge from the printhead;

a second generation unit configured to generate urgency of analog-digital conversion of the detection signal in accordance with the position represented by the signal outputted from the encoder;

a first determination unit configured to determine based on the urgency whether to cause the converter to perform analog-digital conversion;

a stop unit configured to stop control signal generation by said first generation unit if said first determination unit has determined to cause the converter to perform analog-digital conversion;

a second determination unit configured to determine whether a printing operation by the printhead is being performed;

an analog-digital conversion control unit configured to control to cause the converter to perform analog-digital conversion of the detection signal if said second determination unit has determined that the printing operation by the printhead is not being performed, if said second determination unit has determined that the printing operation by the printhead is being performed, control to cause the converter to perform analog-digital conversion of the detection signal after an end of the printing operation by the printhead;

a third determination unit configured to determine whether the analog-digital conversion has ended; and a resumption unit configured to immediately resume control signal generation stopped by said stop unit if said third determination unit has determined that the analog-digital conversion has ended, if said third determination unit has determined that the analog-digital conversion has not ended, resume control signal generation stopped by said stop unit after an end of the analog-digital conversion.

2. The apparatus according to claim 1, wherein said first determination unit further comprises a fourth determination unit configured to determine to immediately cause the converter to perform analog-digital conversion if the urgency is highest, if the urgency is not highest, compare a period of the control signal generated by said first generation unit with a predetermined reference value and determine to immediately cause the converter to perform analog-digital conversion if the period is larger than the reference value, and the reference value is set to be larger as the urgency of analog-digital conversion of the detection signal becomes lower.

3. The apparatus according to claim 1, wherein the urgency of analog-digital conversion of the detection signal is set to be higher as the position of the printhead in each of a plurality of blocks obtained by dividing one period of scanning becomes closer to an endmost position of the block.

4. The apparatus according to claim 1, further comprising a storage unit configured to store, in a storage area, the position represented by the signal output from the encoder at a point of time when said first determination unit has determined to cause the converter to perform analog-digital conversion.

5. A printhead control method executed in an inkjet printing apparatus including an encoder which outputs a signal representing a position of a printhead that reciprocally moves in a predetermined direction, a sensor which detects a temperature of the printhead, and a converter which analog-digital converts a detection signal detected by the sensor, the method comprising the steps of:

generating, based on the signal output from the encoder, a control signal to control ink discharge from the printhead;

generating urgency of analog-digital conversion of the detection signal in accordance with the position represented by the signal output from the encoder;

determining based on the urgency whether to cause the converter to perform analog-digital conversion;

stopping control signal generation in the step of generating the control signal if it is determined, in the step of determining whether to cause the converter to perform analog-digital conversion, to cause the converter to perform analog-digital conversion;

determining whether a printing operation by the printhead is being performed;

controlling to cause the converter to perform analog-digital conversion of the detection signal if it is determined, in the step of determining whether the printing operation is being performed, that the printing operation by the printhead is not being performed, but if it is determined, in the step of determining whether the printing operation is being performed, that the printing operation by the printhead is being performed, controlling to cause the converter to perform analog-digital conversion of the detection signal after an end of the printing operation by the printhead;

determining whether the analog-digital conversion has ended; and immediately resuming control signal generation stopped in the step of stopping control signal generation if it is determined, in the step of determining whether the analog-digital conversion has ended, that the analog-digital conversion has ended, but if it is determined, in the step of determining whether the analog-digital conversion has ended, that the analog-digital conversion has not ended, resuming control signal generation stopped in the step of stopping control signal generation after an end of the analog-digital conversion.

* * * * *